US007767027B2

(12) United States Patent
Schiffer et al.

(10) Patent No.: US 7,767,027 B2
(45) Date of Patent: Aug. 3, 2010

(54) METHOD AND APPARATUS FOR REMOVING COMBUSTION RESIDUES USING DIFFERENT CLEANING MEDIA

(75) Inventors: Achim Schiffer, Bedburg (DE); Helmut Robiné, Rommerskirchen (DE); Dieter Rüsenberg, Bergheim (DE); Stephan Schwenke, Rommerskirchen (DE); Helmut Dombrowski, Bergheim (DE); Manfred Frach, Wesel (DE); Frank Völker, Mülheim (DE)

(73) Assignee: Clyde Bergemann GmbH, Wesel (DE)

( * ) Notice: Subject to any disclaimer, the term of this patent is extended or adjusted under 35 U.S.C. 154(b) by 135 days.

(21) Appl. No.: 11/311,729

(22) Filed: Dec. 19, 2005

(65) Prior Publication Data

US 2006/0141408 A1 Jun. 29, 2006

(30) Foreign Application Priority Data

Dec. 17, 2004 (DE) ..... 10 2004 060 884

(51) Int. Cl.
*B08B 9/00* (2006.01)

(52) U.S. Cl. ..... 134/22.1; 134/2; 134/22.11; 134/22.12; 134/22.15; 134/22.18; 134/26; 134/30; 134/34; 134/36; 134/42

(58) Field of Classification Search ..... 134/26, 134/2, 22.1, 22.12, 22.11, 22.15, 22.18, 30, 134/34, 36, 42
See application file for complete search history.

(56) References Cited

U.S. PATENT DOCUMENTS 2,351,163 A * 6/1944 Thomas ..... 122/379
2,490,759 A * 12/1949 Tyden ..... 165/95
2,995,477 A * 8/1961 Florence ..... 134/22.19
3,415,230 A * 12/1968 Reale ..... 122/379
4,141,754 A * 2/1979 Frauenfeld ..... 134/24
4,422,882 A 12/1983 Nelson et al.
4,699,665 A * 10/1987 Scharton et al. ..... 134/1
4,972,805 A * 11/1990 Weems ..... 122/383
5,019,329 A * 5/1991 Franklin et al. ..... 376/316
5,040,262 A 8/1991 Albers et al.
5,045,292 A * 9/1991 Ruegg et al. ..... 423/235
5,149,380 A * 9/1992 Decker ..... 134/22.18
5,305,713 A * 4/1994 Vadakin ..... 122/391
5,336,081 A * 8/1994 Saito et al. ..... 431/4

(Continued)

FOREIGN PATENT DOCUMENTS

DE 2 058 766 5/1972

(Continued)

*Primary Examiner*—Sharidan Carrillo
(74) *Attorney, Agent, or Firm*—Laurence A. Greenberg; Werner H. Stemer; Ralph E. Locher

(57) ABSTRACT

A method removes combustion residues from a wall of a chamber which carries combustion gases and/or from at least one component which is disposed in the chamber. The method includes making contact between the combustion residues and a first cleaning medium, and making contact between the pretreated combustion residues and a second cleaning medium. The first cleaning medium and the second cleaning medium differ at least with regard to a physical state. An apparatus for removing the combustion residues has different cleaning appliances and operating areas which at least partially overlap. The method and the apparatus allow, for example, heat exchanging surfaces in steam generators to be cleaned in a particular careful and thorough manner.

14 Claims, 4 Drawing Sheets

U.S. PATENT DOCUMENTS

| | | | | | |
|---|---|---|---|---|---|
| 5,357,879 | A | * | 10/1994 | Shiono et al. | 110/188 |
| 5,509,607 | A | * | 4/1996 | Booher et al. | 239/289 |
| 5,534,230 | A | * | 7/1996 | Johnson et al. | 422/173 |
| 5,834,722 | A | * | 11/1998 | Tokunaga et al. | 204/157.3 |
| 5,841,826 | A | * | 11/1998 | Rootham et al. | 376/316 |
| 6,105,590 | A | | 8/2000 | Martin et al. | |
| 6,432,373 | B1 | * | 8/2002 | Tanazawa et al. | 423/235 |
| 2002/0123434 | A1 | * | 9/2002 | Nagamatsu et al. | 508/192 |
| 2003/0070629 | A1 | | 4/2003 | Bartels et al. | |
| 2003/0226576 | A1 | * | 12/2003 | Gray et al. | 134/1 |

FOREIGN PATENT DOCUMENTS

| | | | | |
|---|---|---|---|---|
| DE | 31 06 421 | A1 | | 11/1982 |
| DE | 1256761 | A2 | * | 11/2002 |
| DE | 20220441 | U1 | * | 7/2003 |
| DE | 102 20 091 | A1 | | 11/2003 |
| EP | 0 391 038 | A1 | | 10/1990 |
| EP | 1 256 761 | A2 | | 11/2002 |
| GB | 2178335 | A | * | 2/1987 |
| JP | 357115699 | A | * | 7/1982 |
| JP | 402219905 | | * | 9/1990 |
| JP | 10306913 | A | | 11/1998 |
| WO | 01/65179 | A1 | | 9/2001 |

* cited by examiner

METHOD AND APPARATUS FOR REMOVING COMBUSTION RESIDUES USING DIFFERENT CLEANING MEDIA

BACKGROUND OF THE INVENTION

Field of the Invention

The present invention relates to a method for removing combustion residues from a wall of a chamber which carries combustion gases and/or from a wall of at least one component which is disposed in the chamber, in particular from hot surfaces. An apparatus is also described, for removing the combustion residues. The invention is used in particular in the field of cleaning heat exchanging surfaces in thermal power stations, waste incineration systems, steam generator systems and similar systems.

The combustion that takes place and the combustion gases that are produced during the process results in that the ash, slag and other impurities which are carried in the combustion gases (referred to for short in the following text as combustion residues) in the end remain adhering to the walls over which they flow and to the heat exchanging surfaces of the combustion chambers, the heat exchangers, and the exhaust line etc. This results in the heat exchanging surfaces which are provided for exchanging heat during operation actually having a heat exchanging efficiency which becomes increasingly poorer. It is therefore necessary for the heat exchanging surfaces, which expression covers, inter alia, boiler walls, meandering pipes, heat exchanger surfaces and the like, to have ash and slag adhering to them removed. Three different concepts are known for cleaning the heat exchanging surfaces and/or the walls of heating systems, steam power systems, waste incineration systems or similar steam generators, which have combustion chambers or boilers or the like.

A first concept for removal of combustion residues is disclosed, for example, in international patent disclosure WO 01/65179, corresponding to U.S. patent disclosure No. 2003/0070629 A1 which describes a so-called water lance blower. Water lance blowers have a water lance which is disposed with its mouth on or in a hatch in the heat system such that it can pivot, and can blow a water jet through the heat system, while it is in operation and while flames and/or exhaust gases are flowing through it, onto wall areas which cannot be accessed from the hatch. Water lance blowers such as these emit a narrow water jet through the combustion chamber onto the opposite wall. The kinetic energy of the water jet and the sudden vaporization in the pores of the combustion residues result in the combustion residues becoming detached from the wall. Owing to the fact that considerable distances have to be covered in some cases here, relatively high pressure is applied to such water lance blowers. The pivoting angle of a water lance blower such as this as well as the high water pressure restrict the usage options since only relatively small areas of the wall can be accessed over short distances, and components that are located there may in some circumstances be damaged.

An apparatus for on-line boiler cleaning is also known from the field of waste incineration systems, in which cleaning agents are supplied by a flexible tube which is heat-resistant and hangs down vertically from above. An apparatus such as this is disclosed, for example, in published European patent application EP 1 256 761 A1. This flexible tube is disposed above a supply tube at the upper end of an empty flue, and is moved to and fro in a predetermined manner, with its nozzle at the same time distributing the cleaning agent uniformly over the circumference. The apparatus can be used in particular wherever it is impossible to access the heat system or the walls to be cleaned from the side.

As a third concept, so-called soot blowers are also known, as disclosed by way of example, in published European patent application EP 0 391 038 A, corresponding to U.S. Pat. No. 5,040,262. Soot blowers such as these are supplied with a pressurized fluid, which is expanded in the nozzles to the ambient pressure in the heated chamber that is to be cleaned. The bubble jets which are formed at the outlet of the nozzles are then used with their high kinetic energy to remove the undesirable combustion residues. The nozzles are disposed on a blowing tube which is moved into the interior of the chamber in order to carry out the cleaning process. The nozzles which are disposed distributed at the end and/or on the circumference thus in each case clean different areas of the chamber and of the components disposed in it. Known soot blowers are configured such that their blowing tube can carry out not only a translational movement relative to the chamber but also their own rotation movement. Therefore, the bubble jets which emerge from the blowing tube propagate in a helical shape through the interior of the chamber.

In known cleaning methods, the configuration and the shape of the boiler are regularly used to choose one of the cleaning concepts mentioned above. Therefore, the characteristics of the steam generator or of the system lead to the choice of one, and only one, local cleaning concept. In this case, compromises are generally reached which, for example, can lead to a relatively high repetition frequency for the cleaning process, to an unsatisfactory cleaning effect and/or, in addition, to damage to the walls being cleaned. Bearing in mind the fact that the cleaning has a considerable influence on the temperatures in the steam generator and thus on the efficiency, frequent, inefficient cleaning processes should be avoided. In addition to increased energy consumption, this can also lead to a high load on the components of the steam generator and of the cleaning appliances. There is thus a risk of high servicing and maintenance costs.

SUMMARY OF THE INVENTION

It is accordingly an object of the invention to provide a method and an apparatus for removing combustion residues using different cleaning media that overcome the above-mentioned disadvantages of the prior art methods and devices of this general type.

One particular object is to propose a method for removal of combustion residues, which has a particularly good cleaning effect and can be used even during operation of the steam generator, and which can preferably be carried out at least semi-automatically. A further aim is to specify an apparatus which likewise allows on-line cleaning which is particularly thorough in terms of the removal of combustion residues. The aim of this is to lead to efficient and cost-effective operation of a steam generator.

The method according to the invention for removing combustion residues from a wall of a chamber which carries combustion gases and/or from at least one component which is disposed in the chamber contains at the steps of: a) making contact between the combustion residues and a first cleaning medium; and b) making contact between the pretreated combustion residues and a second cleaning medium. The first cleaning medium and the second cleaning medium differing at least with regard to a state.

The expression combustion residues relates to, in particular, deposits of ash, slag, soot and the like. These are created when materials are burnt in order to produce hot combustion gases, which come into contact with heat exchanging surfaces in order, for example, to produce and/or to heat water vapor/steam. For these and/or other purposes, the combustion gases originating from a combustion chamber are passed through further areas of a steam generating system where, on the one hand, they come into contact with the walls of chambers and with the walls of components disposed in these chambers, with this being particularly applicable to hot surfaces. The expression "chamber" in this case covers at least combustion chambers, fireboxes, draft flues and empty flues. "Components" such as these may be pipes, tubes, heat exchangers, etc. The chamber and/or the component preferably has convection heat exchanging surfaces.

According to the step a), it is now proposed that the combustion residues first make contact with a first cleaning medium. A fluid is preferably used as the first cleaning medium, in particular a neutral fluid which can be handled easily from the environmental point of view and can be produced cost-effectively.

Once the combustion residues have already been brought into contact with the first cleaning medium, step b) is now carried out, in which a second cleaning medium makes contact with the pretreated combustion residues. A fluid is likewise preferably used as the second cleaning medium, and should satisfy the same requirements as the first cleaning medium.

The first cleaning medium differs from the second cleaning medium at least in terms of the state. Accordingly, by way of example, it is possible for the cleaning media to be in solid form (in particular as a frozen substance, such as ice or the like), in liquid form (in particular in the form of a liquid the majority of which is water) or in gaseous form (in particular air, steam, flue gas, etc.), in which case the nature and scope of use can be chosen on the basis of the dirt characteristic. In particular, it is possible for the first cleaning medium and the second cleaning medium to differ only in terms of the state, but it is also possible for the (for example chemical) composition of the cleaning media also to be chosen to be different. In the method in which a combination of at least two cleaning media in different states is used, it has been possible to verify that a better result is achieved in terms of the removal of combustion residues. This is due in particular to the different mechanisms by which the cleaning media work. The method can in this case preferably be carried out in such a way that the contact with the combustion residues in step a) takes place with less kinetic energy than the contact with the second cleaning medium in step b). In principle, all cleaning concepts and cleaning appliances listed in the introduction could be used to carry out this method.

According to a further refinement of the method, the first cleaning medium is liquid and the second cleaning medium is in the form of a vapor. In this case, water, water vapor or steam is preferably used as the cleaning medium. In this case, it is very particularly preferable for the liquid first cleaning medium to be brought into contact with the combustion residues with little kinetic energy, for example by being sprayed, dripped or the like. In the course of step b), the second cleaning medium, which is in the form of a vapor, is preferably applied to the pretreated combustion residues at a relatively high pressure. In particular, the first cleaning medium is at a first pressure in the range from 1.0 to 10.0 bar, and/or the second cleaning medium is preferably at a second pressure in the range from 8.0 (in particular at least 10.0) to 30.0 bar.

The liquid, first cleaning medium is thus applied to the combustion residues in a particularly careful manner, with the water being able to enter the pores of the combustion residues, and be heated by the temperature in the chamber, and be vaporized. The subsequent application of a flow of a second cleaning medium, which is in the form of a vapor, to these pretreated combustion residues allows thorough removal of combustion residues, which already have a large number of cracks, separation points, etc. owing to the expansion of the water in them. The use of a second cleaning medium in the form of a vapor with high kinetic energy now has the advantage that the pretreated combustion residues are removed, although the wall located underneath them is not excessively loaded at the same time because of the small mass of the vapor. This leads on the one hand to a good cleaning effect and at the same time to very little load on the wall of the chamber or on the components disposed in the chamber, including the hot surfaces, etc.

According to a further refinement of the method, a waiting time in the range from 10 minutes to 18 hours is complied with between step a) and step b). The waiting time is preferably at least 2 hours and/or at most 6 hours. The waiting time is in this case dependent in particular on the characteristic of the dirt. The specified waiting time leads to a particularly good cleaning result. If the waiting time is chosen to be shorter, then in some circumstances the first cleaning medium will not yet have been adequately distributed in the combustion residues or will not yet have been sufficiently expanded as a result of the temperatures there, in which case there is then a risk of the second cleaning step b) not being sufficient to virtually completely remove the combustion residues. If a longer waiting time is chosen, then, for example, this may have effects on the effectiveness of the heat exchanging surfaces and/or of the chamber, since the long time of application can result in a greater reduction in the temperature.

In this context, it shall be noted that simultaneous and/or immediately successive contact with the cleaning media does not lead to a particularly good cleaning result. Tests have shown that, for example, wetted layers of the combustion residues have a particularly open, porous, unstable structure. This is because the sintering effect that normally occurs and the sintering time are interrupted. Normally, the temperature rises ever further as combustion residues accumulate on the hot surfaces, because this provides an ever greater impediment to the heat exchanging process. The sintering process thus occurs in the end, which leads to combustion residues being attached in a manner which is particularly difficult to separate. The layer of combustion residues that has been pretreated with the first cleaning medium now acts as a type of "weak point" which, even if there is a further, external accumulation of combustion residues, allows easy separation of combustion residues from the hot surfaces and under the pretreated layer.

It is also proposed that the chamber be cleaned at the same time that combustion gases are flowing through it. Thus, in particular, a method for removal of combustion residues is described, which can be carried out "on-line" (during operation). This has the advantage that the steam generator need not be shut down for cleaning purposes, so that longer operating times can be achieved.

It is particularly preferable for at least one first cleaning appliance to be used for step a), and for at least one second cleaning appliance to be used for step b). In other words, the cleaning media are provided by separate cleaning appliances. This is particularly advantageous because this allows the different types of contact between the cleaning media and the combustion residues to be achieved in a simple form. This relates in particular to the kinetic energy which is provided in order to make contact. It is also very particularly preferable for these to be cleaning appliances based on different concepts, that is to say cleaning appliances which can be associated either with water lance blowers, flexible tube systems or soot blowers.

According to one development of the method, at least one parameter is first defined for qualification of the combustion residues, with at least one of the steps a) and b) being carried out taking into account the at least one parameter. Therefore, the combustion residues on the walls to be cleaned are first recorded and assessed. Sensors, cameras or the like, for example, may be used for this purpose. However, it is also possible for the qualification of the combustion residues to be carried out visually by an operator. The parameter may, for example, be temperature, heat flow, a distribution of the combustion residues over a reference surface, the thickness of the combustion residues, etc. The parameter may on the one hand be used to initiate the method for removal of combustion residues while, on the other hand, it is also possible for at least one of the parameters to be taken into account when carrying out the steps a) and/or b). By way of example, it may be stated here that the parameter may be used, for example, to vary the amount of the respective cleaning medium, the kinetic energy for making contact with the combustion residues, the waiting time, the operating area, the chemical composition, etc.

According to a further aspect of the invention, an apparatus is proposed for removal of combustion residues from a wall of a chamber which carries combustion gases and/or from at least one component which is disposed in the chamber. The apparatus has at least one first cleaning appliance and at least one second cleaning appliance and is characterized in that the at least one first cleaning appliance has a device for distribution of a first, liquid cleaning medium, and the at least one second cleaning appliance has a device for distribution of a second, gaseous cleaning medium in the chamber, with these appliances having operating areas which at least partially overlap. An apparatus such as this is particularly suitable for carrying out the method according to the invention as has been described in more detail above.

The apparatus allows combined liquid and gas cleaning, which leads to an excellent cleaning result while being particularly gentle to the material. In order to allow cleaning such as this to be carried out, the wall areas to be cleaned must be accessible both by the first cleaning appliance and by the second cleaning appliance. The areas of the chamber and of the components disposed in it which are accessible with a cleaning appliance with the cleaning agent are referred to here as the operating area. Therefore, the cleaning medium is supplied directly to its operating area, that is to say for example by the device which results in the cleaning agent being fed in a specific direction (for example nozzles), although it may also be possible to use the force of gravity. The operating area accordingly in particular excludes those surfaces which are reached only by chance and/or as a function of the operating state of the steam generator system, for example water droplets transported with the combustion gas, etc. An appropriate (locally limited) operating area can thus be associated with each cleaning appliance. In the case of the apparatus proposed here, the first cleaning appliance and the second cleaning appliance are now disposed such that their operating areas at least partially overlap. Since operating areas of difference size or different types occur depending on the configuration of the cleaning appliance, it is possible to associate a plurality of other (second or first) cleaning appliances with one (first or second) cleaning appliance. It is likewise also possible for the cleaning appliances to be disposed such that they can move with respect to the chamber, so that they have different operating areas at different times. The arrangement of the first and second cleaning appliances with respect to one another can be chosen, for example, paying particular attention to the configuration of the chamber and the amount of dirt. With respect to gas cleaning, it should be noted that the second cleaning appliance may emit, for example air, vapor and/or the flue gas itself, although it is also possible for the second cleaning appliance to be in the form of a type of sound emitter.

According to a further refinement, the first cleaning appliance has a liquid distribution device which can be moved vertically, and the second cleaning appliance has a vapor distribution device which can be moved horizontally. In particular, the cleaning appliances are provided with devices (for example nozzles) which can be moved relative to the walls of the chamber and of its components. In this case, water and water vapor or steam are once again preferably used as cleaning media, although additives or other additional substances which assist the cleaning process can also be added. With respect to the liquid distribution device which can be moved vertically, it is advantageous for at least some of the water to be emitted in the horizontal direction, thus allowing the water to be distributed widely and uniformly with relatively little kinetic energy. The liquid distribution device in this case acts in a similar manner to a variable-height shower. The second cleaning appliance is advantageously positioned with respect to the chamber such that the vapor distribution device can be inserted, at least at times, horizontally into inner areas of the chamber. The various movement directions of the distribution devices in the interior of the chamber allows a particularly flexible arrangement of the cleaning appliances. Furthermore, for example, it is possible to add in some suitable manner to conventional cleaning systems which, for example, have vapor distribution devices which can be moved only horizontally, a first cleaning appliance containing a liquid distribution device which can be moved vertically, and thus to cost-effectively retrofit the method according to the invention and the apparatus according to the invention.

In this context, it is particularly advantageous for the at least one second cleaning appliance to be a soot blower. Reference should be made to the introductory descriptions and to the explanatory notes in conjunction with the figures with regard to the function and method of operation of a soot blower. The distribution of vapor and/or air by soot blowers is, as described in the introduction, a well-known and proven technology, which achieves particularly good cleaning results in conjunction with the invention.

According to one advantageous development of the apparatus, a device for identification of combustion residues are provided on the wall. In other words, the combustion residues on the wall are identified, and are advantageously also qualified, by the device for example, of sight glasses, sensors, cameras or other recording units. The device is preferably connected to a controller which is in turn in contact with the cleaning appliances, so that the cleaning appliances can act at least semi-automatically as a function of the identified parameters and of the current combustion residues.

The invention also proposes that at least the at least one first cleaning appliance or the at least one second cleaning appliance be moveable with respect to the chamber. Therefore, the first cleaning appliance and/or the second cleaning appliance covers different operating areas with respect to the chamber by being positioned at different points in the chamber. As a consequence of the changed position, other walls of the chamber and of the components are also brought into contact with the cleaning media. In one preferred refinement, the at least one first cleaning appliance is configured such that it can be moved with respect to the chamber.

The invention is particularly advantageous in conjunction with a steam generator, which in this context relates in particular to thermal power stations, waste incineration systems, etc.

The invention and the technical field will be explained in more detail in the following text with reference to the figures. In this case, it should be noted that the figures illustrate only particularly preferred refinements of the invention, but the invention is not restricted to these. The illustrations in the figures are schematic and are normally not suitable to illustrate physical dimensions.

Other features which are considered as characteristic for the invention are set forth in the appended claims.

Although the invention is illustrated and described herein as embodied in a method and an apparatus for removing combustion residues using different cleaning media, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
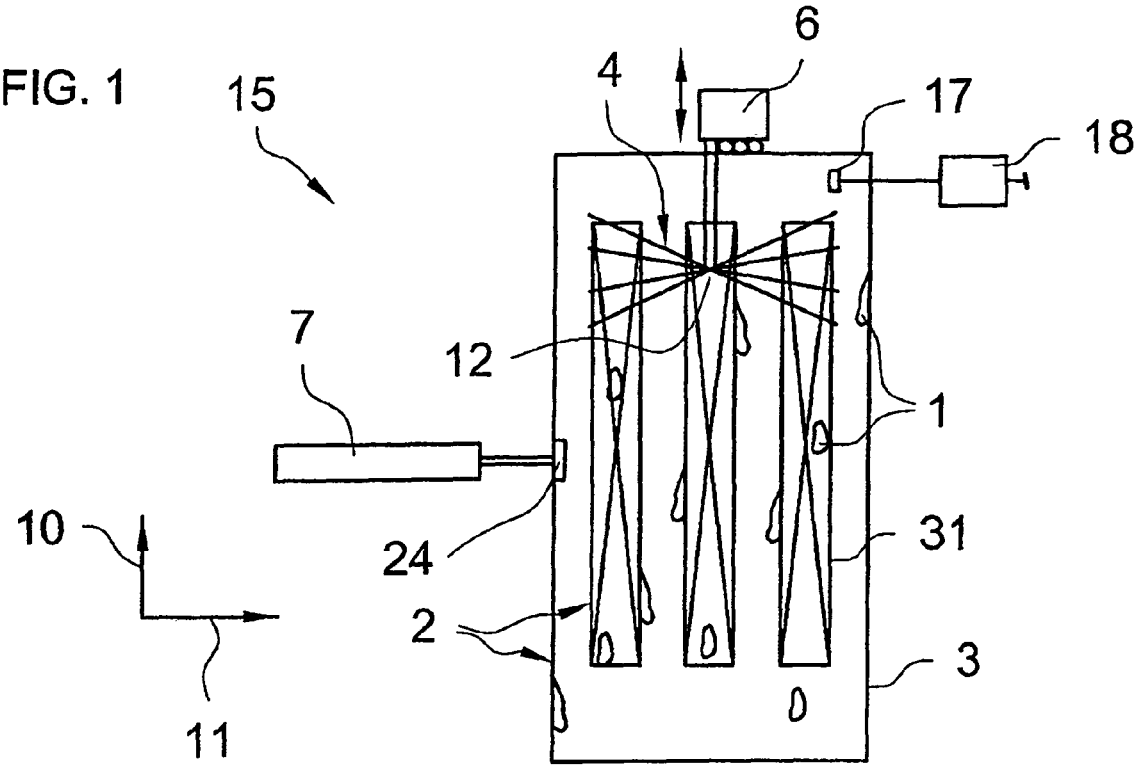
FIG. 1 is a diagrammatic illustration of a chamber while carrying out the method step a) according to the invention.

Referring now to the figures of the drawing in detail and first, particularly, to FIG. 1 thereof, there is shown a part of a steam generator 15. The steam generator 15 includes an apparatus for removing combustion residues 1 from a wall 2 of a chamber 3 which carries combustion gases, and a plurality of components 31 which are disposed in the chamber 3. A first cleaning appliance 6 is provided at the top with respect to the chamber 3, and a second cleaning appliance 7 is provided at the side of the chamber 3. A sensor 17 (as an example of a plurality of sensors), which is connected to a controller 18, is illustrated for identification and qualification of the combustion residues 1. The results of the identification and qualification of the combustion residues 1 can be used for operation of the first cleaning appliance 6 and/or of the second cleaning appliance 7, and/or for carrying out the method for removing the combustion residues 1.

FIG. 1 schematically illustrates method step a), in which a first cleaning medium 4 makes contact with the combustion residues 1. The first cleaning appliance 6 in this case has a liquid distribution device 12 which can be moved vertically. While the liquid distribution device 12 is being moved in the direction of the vertical 10 (up and/or down), and water is dripping onto the walls 2 during this process, the second cleaning appliance 7 is in an inactive state, being positioned outside the chamber 3 and being protected by a closure 24 against the combustion gases flowing in the interior of the chamber 3. In order to carry out the method step a), it may be necessary to move the liquid distribution device 12 over the entire height (in the direction of the vertical 10), although it is also possible for this to be done only partially, in which case it is also possible for the first cleaning medium 4 to make repeated contact with the combustion residues 1 (for example a first time while the liquid distribution device 12 is being moved downwards, and a second time while it is being moved upwards).

Figure 2:
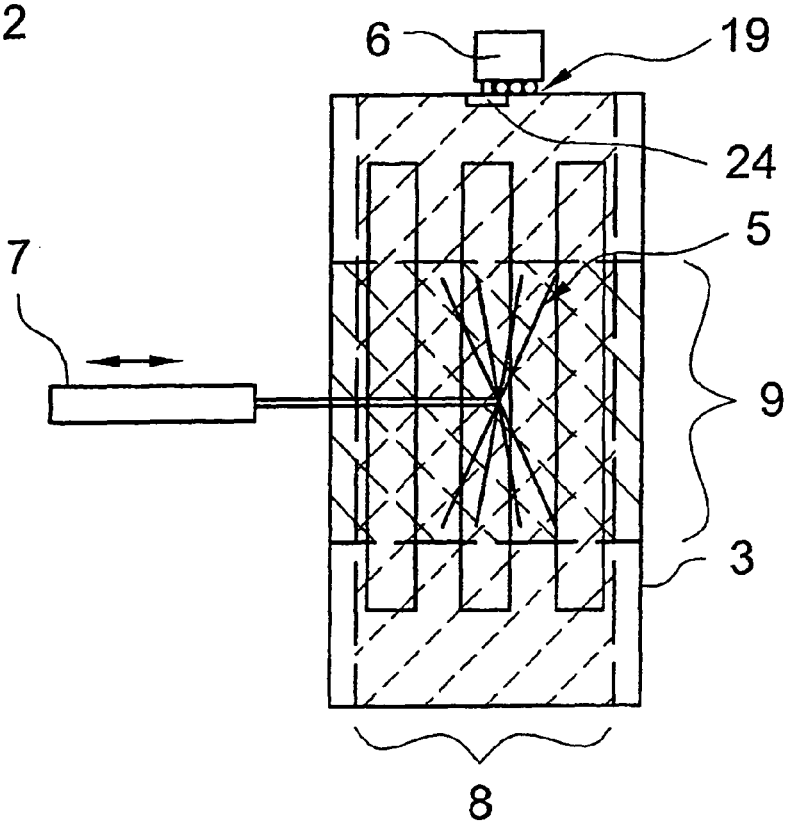
FIG. 2 is a diagrammatic illustration of the chamber while carrying out the method step b)

FIG. 2 shows a second method step b), in which a second cleaning medium 5 makes contact with the pretreated combustion residues 1. The second cleaning medium 5 preferably differs from the first cleaning medium 4 only in its state, so that the first cleaning medium 4 is advantageously water, and the second cleaning medium 5 is advantageously water vapor or steam. The first cleaning appliance 6 is now preferably inactive during the method step b), and is positioned such that it is protected against the combustion gases by a closure 24. While the method step b) is being carried out, the first cleaning appliance 6 may, for example, be moved by a guide 19 to a different position with respect to the chamber 3 and, if required, can start to carry out the method step a) from there again, with a different operating area.

In order to carry out method step b), the illustrated second cleaning appliance 7 has a vapor distribution device 13 which can be moved horizontally. The vapor distribution device 13 can thus be moved to and fro in the direction of the horizontal 11 within the chamber 3. The vapor distribution device 13 emits vapor onto the walls 2 to be cleaned at least at times during the horizontal movement.

As can be seen from FIG. 2, each cleaning appliance has a separate operating area. The operating area for the first cleaning appliance 6 is limited by the vertical movement of the liquid distribution device 12 and by its horizontal range. This results in a first operating area 8, which is illustrated shaded by dashed lines in FIG. 2. A second operating area 9 for the second cleaning appliance 7 is defined by the horizontal movement of the vapor distribution device 13 and by its range in the vertical direction. The second operating area 9 is illustrated by dashed shading in the opposite direction. As can be seen from FIG. 2, the cleaning appliances 6, 7 are disposed such that the operating areas 8, 9 partially overlap. For clarity, it should be mentioned at this point that the operating areas are normally three-dimensional spaces, although for simplicity they are described here as being only two-dimensional.

Figure 3:
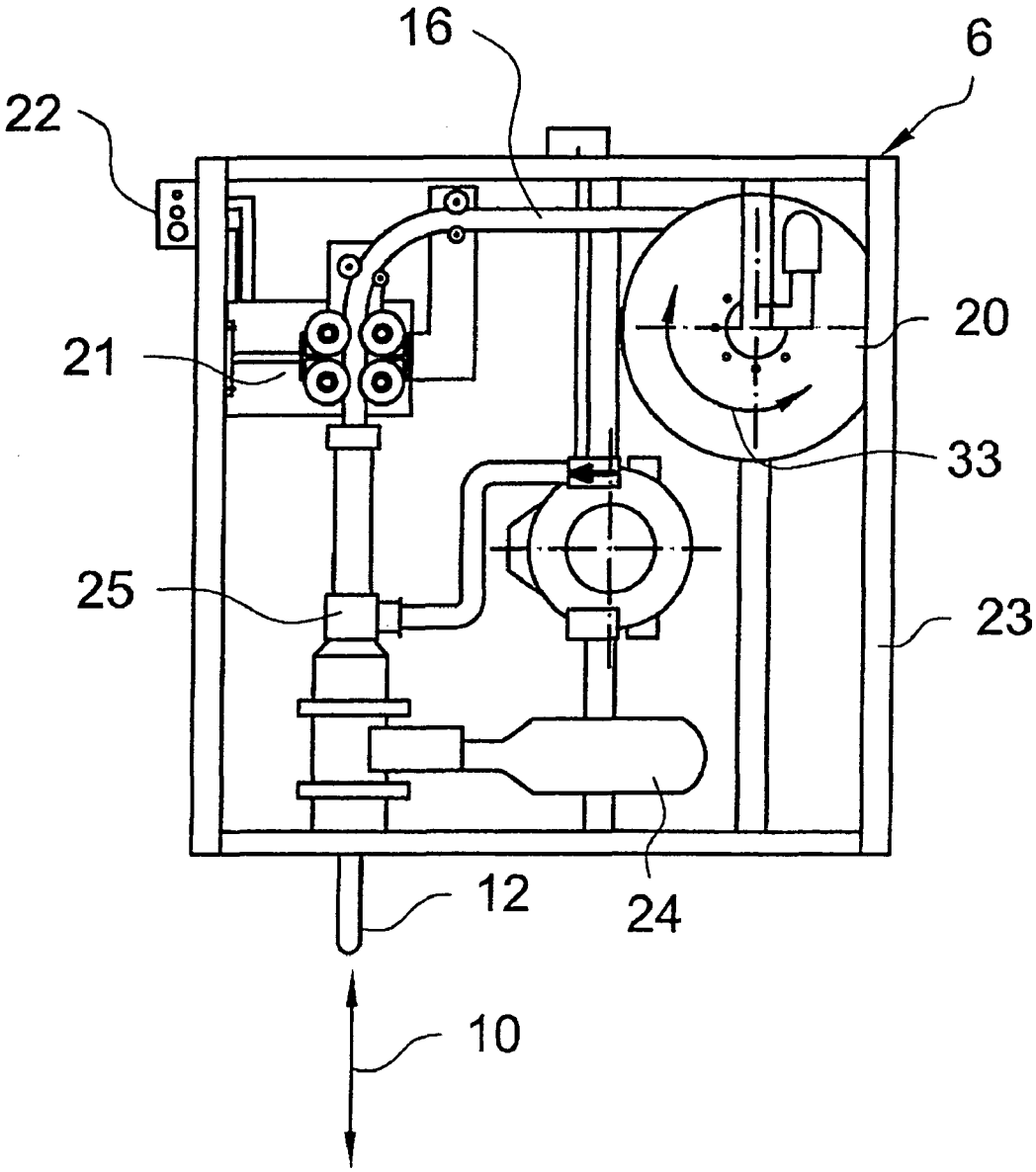
FIG. 3 is a diagrammatic illustration showing one preferred embodiment variant of a first cleaning appliance.

FIG. 3 shows one preferred refinement of the first cleaning appliance 6. This has a heat-resistant flexible tube 16, which can be inserted into the chamber 3 from above in the direction of the vertical 10. A spool 20 is used to store the flexible tube 16 in the inactive state, and allows the flexible tube 16 to be wound up by a driven rotary movement 33. The controlled movement of the liquid distribution device 12 along the vertical 10 at predetermined speeds (variably and/or constant) and over predetermined lengths is provided by a drive unit 21, which allows for movement by rollers which make a friction contact. In addition, a non-illustrated device can be provided for distance measurement. A barrier air apparatus 25 is provided in order to cool the flexible tube 16 and/or to prevent combustion gases from flowing in. By way of example, this provides an air flow which flows towards the chamber 3 in the form of an encasing jet. In the illustrated embodiment variant, the closure 24 is also provided, so that a hatch in the housing 23 can be closed towards the chamber 3 when the flexible tube 16 has been pulled in completely. The components of the first cleaning appliance 6 mentioned above are preferably disposed protected in the housing 23. In the situation in which the first cleaning appliance 6 is intended to be operated semi-automatically, the cleaning process can be initiated, for example, via a control element 22 which is provided on the outside of the housing 23.

Figure 4:
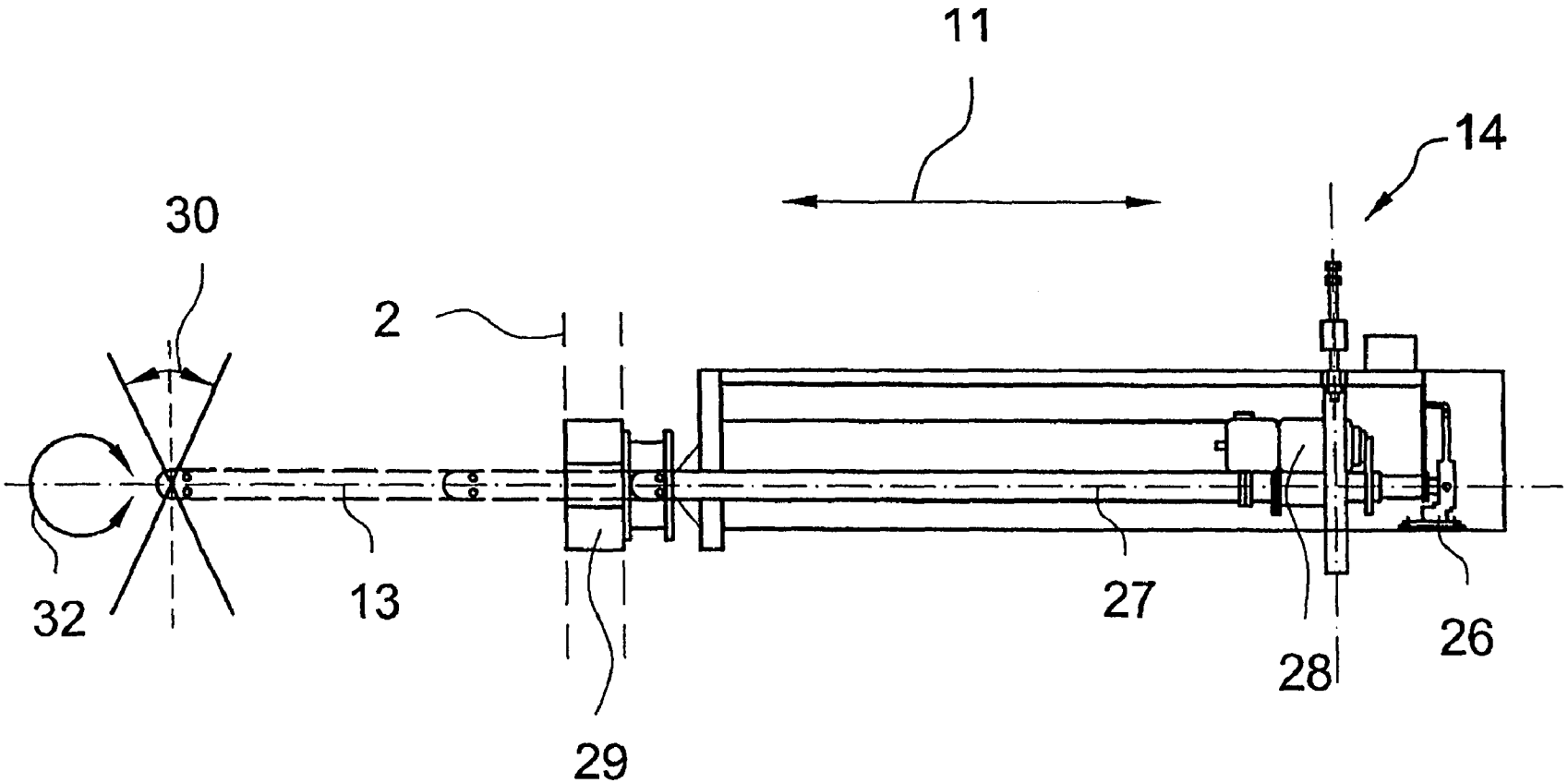
FIG. 4 is a diagrammatic illustration showing one particularly preferred embodiment variant of a second cleaning appliance.

FIG. 4 shows, schematically, one embodiment variant of the second cleaning appliance in the form of a soot blower 14. The soot blower 14 has a blowing tube 27 which can be moved in the direction of the horizontal 11. For this purpose, the soot blower 14 is generally positioned such that it is fixed on the wall 2 of the chamber 3, and the blowing tube 27 can be inserted into internal areas of the chamber 3 through a wall box 29. The movement of the blowing tube 27 is on the one hand translational in the direction of the horizontal 11, although it is also possible to generate a movement of the blowing tube 27 in a rotation direction 32 at the same time. An appropriate drive system 28 is provided for this purpose. The vapor is supplied to the blowing tube 27 by a vapor supply 26, which passes the water vapor or steam through inner areas of the blowing tube 27 to the vapor distribution device 13. The water vapor then emerges in the area of the vapor distribution device 13, preferably radially with respect to the blowing tube 27, and in particular at an angle 30.

Figure 5:
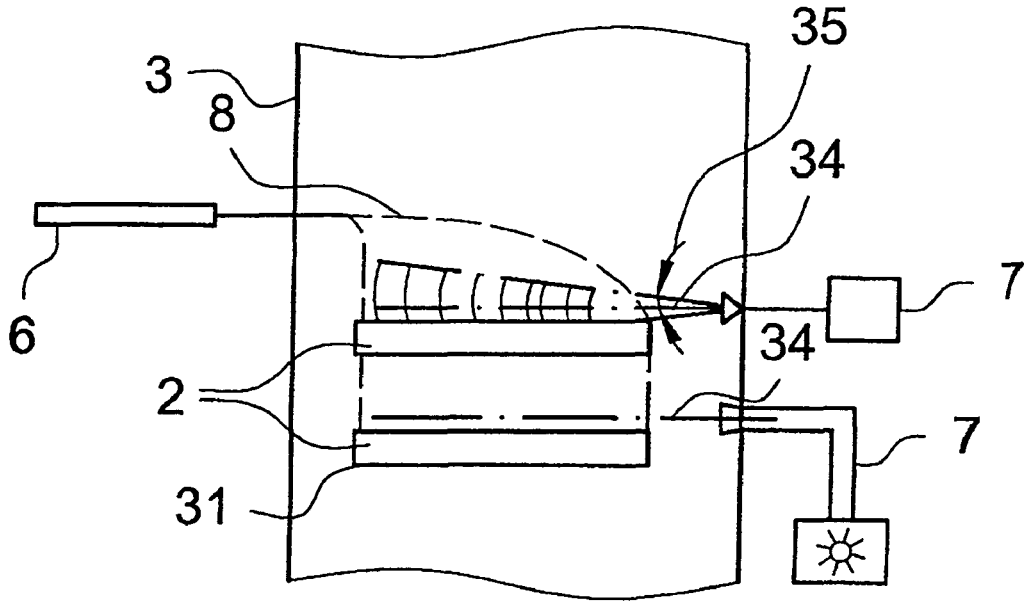
FIG. 5 is a diagrammatic illustration of a further refinement of the chamber with the cleaning appliances.

FIG. 5 shows a detail of the chamber 3 with the different cleaning appliances 6, 7. The chamber 3 is a part of a high-performance steam generator, in which the chamber 3 is installed vertically, and the components 31 with the walls 2 to be cleaned are disposed horizontally. FIG. 5 now shows, schematically, the first cleaning appliance 6 which distributes the first cleaning medium onto the walls 2 (in particular convection hot surfaces). By way of example, the first cleaning appliance 6 may be in the form of a water lance blower, in which case the first operating area 8 can be selected by different pressure and the effect of the force of gravity, in such a way that the walls 2 can be wetted. For the situation illustrated here, in which the components 31 are in the form of pipes or tubes, the first cleaning medium can also reach components 31 which are disposed further below, through the cutouts between the cooling pipes.

Two different second cleaning appliances 7 are illustrated schematically for supplying the second cleaning medium. The second cleaning appliance 7 which is illustrated at the top is a sound transmitter which can emit directional sound in a propagation direction 34, the sound propagating with a small beam angle 35, for example in an area of less than 20°, and in particular of less than 5° (the operating area is in this case the sound lobe with the stated propagation direction and the stated beam angle). In this case, the second cleaning medium represents the combustion gas that is located in the chamber 3 and is now used to remove the combustion residues. As a further variant of the second cleaning appliance 7, an apparatus is indicated at the bottom on the right by which a gas flow in the direction of the propagation direction 34 can be emitted with high kinetic energy. For example, it is possible for a controlled explosion to be carried out in the second cleaning appliance 7, which produces or speeds up a flue gas (second cleaning medium). This gas flow is now deliberately applied to the pretreated hot surfaces 2, and thus cleans them. In addition, with respect to the propagation direction 34, it should also be mentioned that this is advantageously directed substantially at right angles to the walls to be cleaned, although, only in the case of the variant illustrated here with horizontally disposed components 31, the propagation direction 34 is preferably aligned parallel to or slightly inclined with respect to the horizontal.

Figure 6:
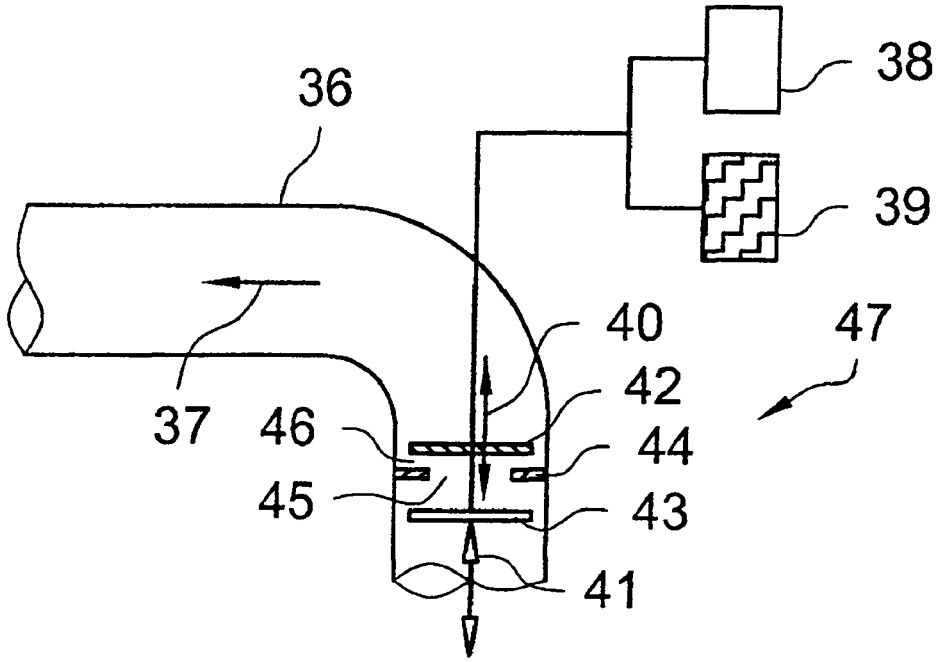
FIG. 6 is a diagrammatic illustration showing one particularly preferred refinement of a valve for supplying the cleaning medium to a cleaning appliance.

FIG. 6 shows, schematically, one particularly preferred refinement of a valve 47 for supplying a cleaning medium (in particular a liquid cleaning medium) to a cleaning appliance (in particular a soot blower). The cleaning medium is supplied via a tube-like supply line 36, in which the cleaning medium is guided with a flow direction 37. The flow of the cleaning medium is regulated by the schematically illustrated valve 47. The valve 47 has an adjusting disc 42 and a linear-movement disc 43, which are each disposed on one side of a baffle 44, which is fitted in the supply line 36 and has an opening 45. In the closed state, the linear-movement disc 41 makes gas-tight contact with the baffle 44, so that no cleaning medium can flow through the opening 45. When required, the linear-movement disc 43 is now moved downwards (together with the adjusting disc 42) with a linear movement 41 (indicated by white arrows), so that the opening 45 is accessible for the cleaning medium. The flow is now regulated by varying the distance between the adjusting disc 42 and the baffle 44 (independently of the linear movement 41) with an adjusting movement 40, that is to say a relative movement takes place between the adjusting disc and the linear-movement disc. This now allows a defined gap 46 to be produced between the baffle 44 and the adjusting disc 42, which limits the flow. In the illustrated embodiment of the valve 47, a separate drive (adjusting drive 39 and linear drive 38) is provided for each movement (adjusting movement 40 and linear movement 41), and these drives can be operated independently of one another (preferably by means of a common controller). In one very particularly preferable variant, the linear movement 41 is activated by a mechanical device (for example on movement of the cleaning appliance), and the adjusting movement 42 can be set as required depending on the desired cleaning process.

The methods and apparatuses described here for removal of combustion residues are distinguished by a particularly good cleaning effect and by the walls to be cleaned being treated gently. Furthermore, significant improvements can be achieved with regard to the operation of steam generator systems.

This application claims the priority, under 35 U.S.C. §119, of German patent application DE 10 2004 060 884.9, filed Dec. 19, 2004; the entire disclosure of the prior application is herewith incorporated by reference.

We claim:

1. A method for removing combustion residues from interior surfaces of a chamber within a steam generator, the chamber carrying combustion gases therein and the combustion residues being deposited in the chamber by the combustion gases, which comprises the steps of:

a) making contact between the combustion residues on the interior surfaces of the chamber carrying the combustion gases in the steam generator and a first cleaning medium resulting in pretreated combustion residues;

b) making contact between the pretreated combustion residues on the interior surfaces of the chamber carrying the combustion gases in the steam generator and a second cleaning medium for removing the pretreated combustion residues from the interior surfaces of the chamber carrying the combustion gases in the steam generator, with the first cleaning medium and the second cleaning medium differing at least with regard to a physical state; and cleaning the chamber while at a same time the combustion gases flow through the chamber.

2. The method according to claim 1, which further comprises:

providing the first cleaning medium in a liquid state; and providing the second cleaning medium in a vapor state.

3. The method according to claim 1, which further comprises setting a waiting time in a range from 10 minutes to 18 hours between performing steps a) and b).

4. The method according to claim 1, which further comprises:

during a performance of step a), using at least one first cleaning appliance; and during the performance of step b), using at least one second cleaning appliance.

5. The method according to claim 1, which further comprises:

determining at least one parameter of the combustion residues; and carrying out at least one of the steps a) and b) based on the at least one parameter.

6. The method according to claim 1, wherein the first cleaning medium is brought into contact with the combustion residues at a first pressure and the second cleaning medium is brought into contact with the combustion residues at a second pressure that is higher than the first pressure.

7. The method according to claim 1, wherein the first cleaning medium and the second cleaning medium only differ in terms of a physical state.

8. The method according to claim 1, wherein the contact with the first cleaning medium in step a) takes place with less kinetic energy than the contact with the second cleaning medium in step b).

9. The method according to claim 1, wherein the first cleaning medium is brought into contact with the combustion residues by spraying or dripping.

10. The method according to claim 1, wherein the second cleaning medium is brought into contact with the pretreated combustion residues under high pressure in a range between 8.0 to 30.0 bar in vapor form.

11. The method according to claim 1, wherein the first pressure is in the range of 1.0 to 10.0 bar and the second pressure is in a range between 8.0 to 30.0 bar.

12. The method according to claim 6, wherein the first pressure is in the range of 1.0 to 10.0 bar and the second pressure is in a range between 8.0 to 30.0 bar.

13. A method for removing combustion residues from interior surfaces of a chamber within a steam generator, the chamber carrying combustion gases therein and the combustion residues being deposited in the chamber by the combustion gases, which comprises the steps of:

a) making contact between the combustion residues on the interior surfaces of the chamber carrying the combustion gases in the steam generator and a first cleaning medium resulting in pretreated combustion residues;

b) waiting until the first cleaning medium has been subsequently distributed into the combustion residues present on the interior surfaces of the chamber;

c) subsequent to the waiting step b), making contact between the pretreated combustion residues on the interior surfaces of the chamber carrying the combustion gases in the steam generator and a second cleaning medium for removing the pretreated combustion residues from the interior surfaces of the chamber carrying the combustion gases in the steam generator, with the first cleaning medium and the second cleaning medium differing at least with regard to a physical state; and cleaning the chamber while at a same time the combustion gases flow through the chamber.

14. The method according to claim 13, wherein the waiting step b) results in cracks in the combustion residues.

* * * * *